US006175712B1

(12) United States Patent
Masuda et al.

(10) Patent No.: US 6,175,712 B1
(45) Date of Patent: Jan. 16, 2001

(54) INTERMEDIATE TRANSFER MEMBER AND IMAGE FORMATION APPARATUS USING SAME

(75) Inventors: Yoshitomo Masuda; Norihiko Kaga, both of Tokyo (JP)

(73) Assignee: Bridgestone Corporation, Tokyo (JP)

( * ) Notice: Under 35 U.S.C. 154(b), the term of this patent shall be extended for 0 days.

(21) Appl. No.: 09/359,660

(22) Filed: Jul. 26, 1999

(30) Foreign Application Priority Data

Jul. 27, 1998 (JP) ..... 10-210583
Jul. 27, 1998 (JP) ..... 10-210587

(51) Int. Cl.[7] ..... G03G 15/14
(52) U.S. Cl. ..... 399/302; 399/308
(58) Field of Search ..... 399/302, 308, 399/297, 313; 430/126

(56) References Cited

U.S. PATENT DOCUMENTS 5,084,735 * 1/1992 Rimai et al. ..... 399/302
5,732,314 * 3/1998 Tsukida et al. ..... 399/302
5,978,639 * 11/1999 Masuda et al. ..... 399/302

* cited by examiner

*Primary Examiner*—Sophia S. Chen
(74) *Attorney, Agent, or Firm*—Oblon, Spivak, McClelland, Maier & Neustadt, P.C.

(57) ABSTRACT

There are disclosed an intermediate transfer member which has the function of transferring an image formed on the surface of an image formation body to a recording medium, and which has a surface hardness of at most 80 N/mm$^2$ expressed in terms of universal hardness at a depth from the surface of the member equivalent to the average particle size of a toner to be used for forming an image or at a depth of 7 $\mu$m; an intermediate transfer member which has the function of transferring an image formed on the surface of an image formation body to a recording medium, and which has a Z value of at least 0.5, in which the Z value is calculated by the following formula;

$$Z=[\text{elastic energy}]/[\text{elastic energy}+\text{plastic energy}] \quad (I)$$

which formula is obtained from deformation restoration behavior of the surface of the intermediate transfer member at the time of measuring the universal hardness of the surface thereof; and an image formation apparatus which is equipped with the intermediate transfer member. The above-mentioned intermediate transfer member is remarkably effective in preventing toner adhesion or fixing and enhancing the durability of itself by virtue of the specific constitution. Further, the member is capable of properly correcting the deformation energy behavior in an extremely shallow region of the member surfaces, and effectively preventing the deformation accompanying the repeated contact of the member with a toner and related members. Thus the durability of the member is surely enhanced.

9 Claims, 3 Drawing Sheets

INTERMEDIATE TRANSFER MEMBER AND IMAGE FORMATION APPARATUS USING SAME

BACKGROUND OF THE INVENTION

1. Field of the Invention

The present invention relates to an intermediate transfer member and an image formation apparatus using the same. More particularly, the present invention pertains to an intermediate transfer member which is employed in an electrophotographic image formation apparatus such as copying machinery, facsimile machinery and laser printers, and which prevents toner fixing, or improves the behavior of repeated deformation due to contact with a toner, a photosensitive body, a secondary transfer member, a cleaning member and the like, and thus enhances its durability; and an image formation apparatus which is equipped with said intermediate transfer member.

2. Description of the Background

In the conventional electrophotographic image formation apparatus such as copying machinery, facsimile machinery and laser printers, printed images have heretofore been obtained by a method comprising the steps of allowing the surface of a photosensitive body, that is, an image formation body to be charged uniformly; projecting an image from an optical system on the photosensitive body to remove the charge of the light-irradiated portion, thereby forming an electrostatic latent image; then supplying the resultant electrostatic latent image with a toner from a developing roller or the like to form a toner image by the electrostatic adhesion; transferring the resultant toner image to a recording medium such as paper by means of a transfer roller or the like; and heat fixing said image by the use of a fixing roller or the like so as to obtain the objective printed image.

Likewise in color printers and color copying machinery, printing is carried out basically in accordance with the above mentioned process. In the case of color printing, since the color tone is reproduced by the use of four toners having different colors including magenta, yellow, cyan and black, there is required a step for the purpose of obtaining the desired color tone by superimposing the aforesaid toners at a prescribed ratio. Thus several proposals have been made on a method for putting the above-mentioned step into practice.

There is available as a first system, a multiple development system in which at the time of visualizing an electrostatic latent image by supplying a photosensitive body with a toner as is the case with black and white printing, development is carried out by superimposing in turn, the aforesaid four toners having different colors including magenta, yellow, cyan and black so as to form colored toner images on the photosensitive body. Said system, although being capable of constituting a development unit in a comparatively compact manner, involves a problem that the gradation is extremely difficult to control, thus making it impossible to obtain a high quality image.

There is also available as a second system, a tandem system in which four photosensitive bodies are equipped; the latent images of the respective photosensitive bodies are developed with toners having different colors including magenta, yellow, cyan and black, respectively, so as to form four toner images with magenta, yellow, cyan and black, respectively; the photosensitive bodies on which these toner images are formed are arranged in a row and are consecutively transferred to a recording medium such as paper; and said images thus transferred are superimposed on the recording medium so as to reproduce color images. However, although favorable images are obtained, the above-mentioned system brings about a state in which the four photosensitive bodies and the electrically charging mechanism and development mechanism that are installed per each photosensitive body, are arranged in a row, whereby the development unit is made unfavorably large-sized and expensive.

There is further available as a third system, a transfer drum system in which a recording medium such as paper is wound around a transfer drum; said drum is rotated four times, while toners of magenta, yellow, cyan and black, respectively, on the photosensitive body are consecutively transferred to a recording medium such as paper per each one rotation so as to reproduce color images. However, although comparatively high quality images are obtained, the above-mentioned system involves the problem that in the case where a recording medium is a thick sheet of paper such as a postcard, said medium is difficult to wind around a transfer drum, thereby unfavorably limiting the kind of the recording medium to be used.

As a countermeasure against the foregoing multiple development system, tandem system and transfer system, there is proposed an intermediate transfer system as a system capable of producing a favorable quality of image without necessitating a large-sized apparatus in particular or specifically restricting the kind of a recording medium.

The intermediate transfer system is a system which comprises equipping the system with an intermediate transfer member made up of a drum or a belt which once transfers and retains the toner images on a photosensitive body to and on itself; consecutively transferring to said intermediate transfer member, the four color images on the photosensitive body, that is, four toner images with magenta, yellow, cyan and black, respectively so as to form color toner images on said intermediate transfer member; and transferring the resultant color toner image to a recording medium such as paper. The above-mentioned intermediate transfer system is capable of producing high quality images, since the system regulates the gradation by superimposing the four color toner images, dispenses with a large-sized apparatus in particular, since there is no need to arrange photosensitive bodies in a row, differing from the tandem system, and further does not restrict the kind of a recording medium, since there is no need to wind a recording medium on a drum, differing from the transfer drum system.

However, with respect to the above-mentioned intermediate transfer system, the intermediate transfer member is liable to raise a problem of durability, since said member comes in contact with a photosensitive body, a secondary transfer member, a cleaning member and the like.

It is known that the durability of the intermediate transfer member is greatly influenced by a slight deformation thereof due to contact thereof with the residual toner, the photosensitive body, the secondary transfer member, the cleaning member and the like. That is to say, the toner which is primarily transferred from the photosensitive body and is retained on the surface of the intermediate transfer member, must be secondarily transferred to a recording medium such as paper in the next step. In the case where, however, by reason of poor secondary transfer or poor cleaning as the matter of tact, part of the toner is left on the intermediate transfer member, and is gradually embedded on the surface of the intermediate transfer member to cause fixing. The toner, if once embedded thereon, begins to be deposited acceleratingly and appears on an image as defective points.

Inherently, it is the fundamental measure to enhance the transfer efficiency as well as cleaning efficiency so as to prevent the toner from remaining on the intermediate transfer member. Nevertheless, with the state of the art it is difficult to remove 100% of the remaining toner.

In addition, the surface of the intermediate transfer member is subjected to repeated deformation in a slight depth owing to the contact of said member with the photosensitive body, the secondary transfer member, the cleaning member and the like, whereby there are caused, though slight, change in the surface configuration of the member, localized distortion of an image, variation in the aspect ratio of an image and the like.

By decreasing the pressure of the contact of the intermediate transfer member with the photosensitive body, the secondary transfer member, and the cleaning member, it is made possible to decrease the repeated deformation due to the contact with the aforesaid members, but such decrease in pressure deteriorates the efficiencies of the primary and secondary transfers, which are the inherent functions of the intermediate transfer member.

In such circumstances, an attempt is made to coat the surface of the intermediate transfer member with a fluorine based material excellent in antifouling properties and sliding properties in order to prevent the residual toner from fixing to the surface of the intermediate transfer member and at the same time, decrease the friction between said member and the photosensitive body, the secondary transfer member, and the cleaning member. It is the present status that said attempt, although being effective to some extent, results in failure to assure sufficient durability.

SUMMARY OF THE INVENTION

A general object of the invention is to provide an intermediate transfer member which is employed in an electrophotographic image formation apparatus such as copying machinery, facsimile machinery and laser printers, and which prevents toner fixing, or improves the behavior of repeated deformation due to contact with a toner, a photosensitive body, a secondary transfer member, a cleaning member and the like, and thus enhances its durability; and an image formation apparatus which is equipped with said intermediate transfer member.

Another objects of the invention will be obvious from the content of the specification hereinafter disclosed.

In such circumstances, intensive research and development were accumulated by the present inventors in order to develop an intermediate transfer member in which a toner is prevented from fixing and the durability thereof is enhanced. As a result, it has been found that at the time of toner fixing due to encroaching thereof, indentations are formed on the surfaces of the intermediate transfer member in a depth of the average particle size of the toner, and that through the attention being paid to the above-mentioned fact, it is made possible to efficiently prevent toner fixing due to encroaching thereof by properly correcting the universal hardness of the portion at a depth same as the average particle size of the toner. It has also been found that even in the case where accurate average particle size of the toner to be used is unknown, it is made possible to efficiently prevent toner fixing due to encroaching thereof up to a practically sufficient level by properly correcting the universal hardness of the portion at a depth of 7 $\mu$m which is the average particle size of generally used toner.

In addition, intensive research and development were accumulated by the present inventors in order to develop an intermediate transfer member which improves the behavior of repeated deformation due to contact with a toner and the other members, and thereby enhances its durability. As a result, special attention has been paid to the fact that in the case of measuring the universal hardness by pushing in a penetrator in the form of a quadrangular pyramid or a triangular pyramid in the surface of an object to be measured under a prescribed test load applied thereto, finding the surface area of contact between the penetrator and the object to be measured from the pushed-in depth of the penetrator, and finding the hardness from the surface area and the test load, it has been made possible to calculate the values of elastic energy ad plastic energy and the ratio of each of said energies in relation to the deformation of the surface of the object to be measured by pushing any of the above-mentioned penetrator in the object to be measured, and thereafter gradually decreasing the test load applied by the penetrator.

Further research and investigation were set forward on the basis of above-mentioned attention. As a result it has been found that by controlling the relation between the aforesaid elastic energy and the plastic energy, it is made possible to properly correct the deformation in the extremely shallow region of the member surfaces which deformation greatly influences the toner encroaching or the deformation due to contact with a photosensitive body, a secondary transfer member, a cleaning member and the like; effectively prevent the deformation accompanying the repeated contact with the toner, the photosensitive body, the secondary transfer member, the cleaning member and the like; and obtain an intermediate transfer member having favorable durability.

The present invention has been accomplished on the basis of the foregoing findings and information.

That is to say, the present invention provides an intermediate transfer member which is located between an image formation body and a recording medium, once retains on the surface thereof, a toner image formed on the image formation body, and transfers said image to a recording medium, wherein said intermediate transfer member has a surface hardness of at most 80 N/mm$^2$ expressed in terms of universal hardness at a depth equivalent to the average particle size of a toner to be used for forming said toner image or at a depth of 7 $\mu$m.

The present invention further provides an intermediate transfer member which is located between an image formation body and a recording medium, once retains on the surface thereof, a toner image formed on the image formation body, and transfers said image to a recording medium, wherein said intermediate transfer member has a Z value of at least 0.5, said Z value being calculated by the following formula $$Z=[\text{elastic energy}]/[\text{elastic energy}+\text{plastic energy}] \quad (I)$$

said formula being obtained from the deformation restoration behavior of the surface of said member at the time of measuring the universal hardness of the surface thereof.

The present invention still further provides an image formation apparatus equipped with the above-mentioned intermediate transfer member.

DETAILED DESCRIPTION OF THE INVENTION

Figure 1:
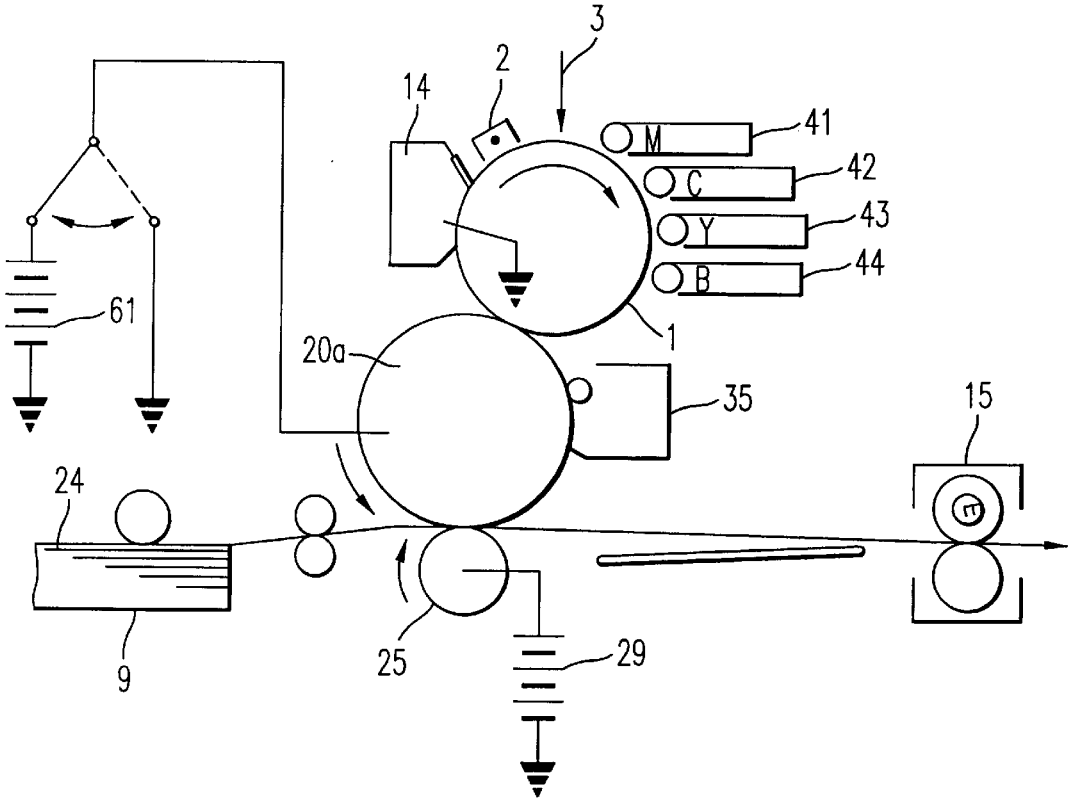
FIG. 1 is a schematic illustration of an example of a color image formation apparatus employing the intermediate transfer member in the form of drum according to the present invention.

The intermediate transfer member according to the present invention is located between an image formation body and a recording medium, and is imparted with the function of once retaining on the surface thereof, a toner image formed on the image formation body and transferring said image to a recording medium.

With regard to the intermediate transfer member according to the present invention, the surface hardness thereof is specified by universal hardness (unit of $N/mm^2$) represented by the following formula, and is obtained by pushing a penetrator in an object of measurement under a test load.

$$\text{Universal hardness}=[\text{test load}]/[\text{surface area of contact between a penetrator and an object of measurement under the test load}] \quad \text{(II)}$$

The universal hardness can be measured by the use of a hardness measuring instrument available on the market, for instance, a ultracompact hardness meter (manufactured by Fischer Corp. under the trade name H-100V). By the use of the above-mentioned hardness measuring instrument, a penetrator in the form of a quadrangular pyramid or triangular pyramid is pushed in the surface of an object to be measured under a prescribed test load applied thereto, the surface area wherein the penetrator and the object are in contact with each other is found at the point of time when a desired pushed-in depth has been achieved, and the universal hardness is calculated by the foregoing formula (II).

In regard to the intermediate transfer member according to the present invention, the universal hardness thereof is at most 80 $N/mm^2$ at a depth equivalent to the average particle size of a toner to be used for forming a toner image on the surface of an image formation body. The universal hardness thereof, when exceeding 80 $N/mm^2$ at said depth, results in failure to sufficiently exhibit the working effect on preventing toner fixing and achieve the objects of the present invention. From the viewpoint of the working effect on preventing toner fixing, said universal hardness is in the range of preferably 0.1 to 80 $N/mm^2$, more preferably 1 to 30 $N/mm^2$.

Specifically, when the average particle size of a toner is 5 $\mu$m, said toner being used in an image formation apparatus in which use is made of the intermediate transfer member according to the present invention, the universal hardness at the point where the penetrator of the above-mentioned measuring instrument is pushed in said member by 5 $\mu$m from the surface thereof, is regulated in the foregoing range.

In the case where the average particle size of the toner to be used in an image formation apparatus in which use is made of the intermediate transfer member according to the present invention is unknown, practically sufficient effect can be exerted by regulating to said range, the universal hardness of the portion at a depth of 7 $\mu$m which is the average particle size of generally used toner.

In the case of measuring said universal hardness, it is made possible to find the values of elastic energy and plastic energy on the surface of the object to be measured and the ratio of each of the energies by gradually pushing a penetrator in said object, while applying an increasing load thereto up to a prescribed load, and thereafter decreasing the load of the penetrator. Assuming that the object to be measured is a perfect elastic body, when a penetrator is pushed in said object to be measured by increasing the load, followed by the removal of the load by decreasing the same, then the surface of said object is restored to the original state, and the penetrator is returned to the original position, that is, a pushed-in depth of zero. On the contrary, if the object to be measured is a perfect plastic body, even when a penetrator is pushed in said object to be measured, followed by the removal of the load, the surface of said object remains non-restored, and the penetrator is not returned to the original position. By taking advantage of the aforesaid phenomenon, the ratio of elastic energy to plastic energy for said object can be determined. This method enables to measure the behavior of deformation in an extremely shallow region of the surface of an intermediate transfer member which has been impossible to measure by a conventional compression set test. The extremely shallow region means the region of from 1 $\mu$m to 500 $\mu$m, approximately in pushed-in depth.

In regard to the intermediate transfer member according to the present invention, it is necessary that a Z value be at least 0.5, wherein the Z value showing the relation between the elastic energy and plastic energy, is represented by the following formula:

$$Z=[\text{elastic energy}]/[\text{elastic energy}+\text{plastic energy}] \quad \text{(I)}$$

When the Z value is less than 0.5, it is made impossible to effectively prevent the deformation of the intermediate transfer member which accompanies the repeated contact with the toner, photosensitive body, secondary transfer member and cleaning member and to obtain the intermediate transfer member having favorable durability. The Z value is preferably in the range of 0.6 to 1, which enables to produce the intermediate transfer member having favorable durability.

In this case, it is possible with a computer or the like to calculate the value of [elastic energy+plastic energy], that is, the total energy from the product of pushing-in load of penetrator and pushing-in depth of penetrator, and the value of elastic energy from the product of load during the course of restoration from which the pushing-in load is removed, and returned distance (depth).

There is no specific limitation on the conditions for measuring the universal hardness, [elastic energy+plastic energy] and elastic energy, provided that the universal hardness is found from the pushing-in depth of penetrator. For instance, in the case of measuring the universal hardness by the use of a ultracompact hardness meter (manufactured by Fischer Corp. under the trade name H-100V), said hardness can be measured by gradually pushing a penetrator in the intermediate transfer member up to a prescribed pushing-in depth under the measuring conditions as described hereinafter, and calculating the same from the load and contact area of the penetrator at the point where the pushing-in depth reaches the prescribed value.

In the case of measuring the [elastic energy+plastic energy] and elastic energy, these values can be measured by pushing a penetrator in the intermediate transfer member up to a prescribed pushing-in depth under the measuring conditions as described hereinafter, and calculating the same by means of a computer alter the prescribed load is maintained for about 10 seconds and subsequently the load is removed.

Measuring conditions

Penetrator: diamond made quadrangular pyramid penetrator having an opposite plane angle of 136 deg.

Initial load: 0.02 mN

Maximum load: 5 to 400 mN

Period of time of increasing load from initial load to maximum load: 10 to 60 seconds The intermediate transfer member according to the present invention needs to have the above-specified universal hardness, or to satisfy the above-specified relationship between elastic energy and plastic energy in regard to the surface of said member. In addition, the intermediate transfer member has a specific volume resistance in the range of preferably $10^3$ to $10^{16}$ Ω·cm, more preferably $10^8$ to $10^{16}$ Ω·cm from the electrostatic function of once retaining on the surface thereof, a toner image formed on the image formation body, and transferring said image to a recording medium.

There is no specific limitation on the form or shape of the intermediate transfer member according to the present invention, provided that the member has the above-specified universal hardness or Z value. Preferably, said member is in the shape of drum or belt.

Figure 2:
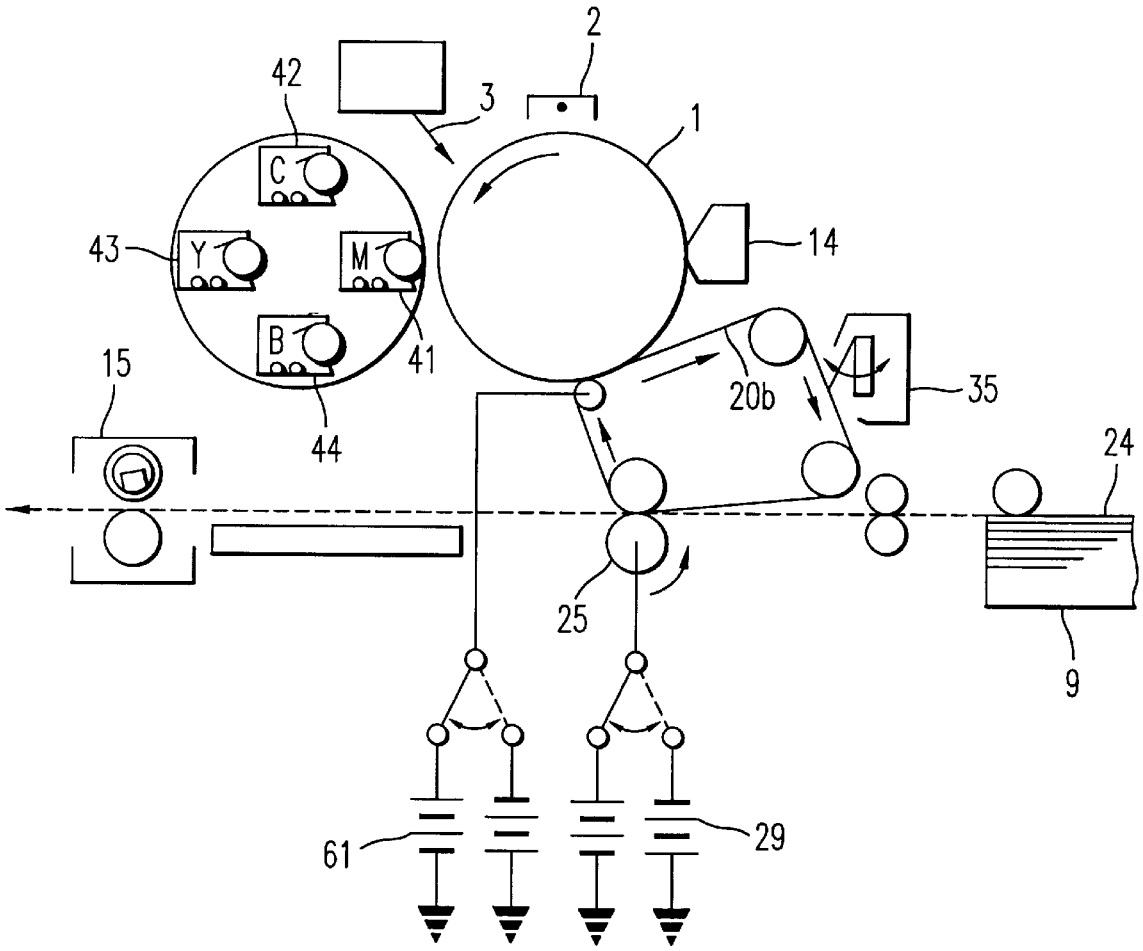
FIG. 2 is a schematic illustration of an example of a color image formation apparatus employing the intermediate transfer member in the form of belt according to the present invention.

FIGS. 1 and 2 are each a schematic illustration of an example of a color image formation apparatus employing the intermediate transfer member in the form of drum and belt, respectively, according to the present invention.

In each of the figures, symbol 1 shows a photosensitive body in the form of drum, which rotates in the direction of the arrow, and is electrically charged with a primary charging unit 2. Subsequently, an electrostatic latent image corresponding to a first color component is formed on the photosensitive body 1 by an image exposure 3. Then the image is developed by a magenta toner M as a first color with a development unit 41. An intermediate transfer member 20*a* or 20*b* rotates in the direction of the arrow at a peripheral velocity same as that in the photosensitive body 1. The toner image formed on the photosensitive body 1 is transferred onto the external peripheral surface of the intermediate transfer member 20*a* or 20*b* by a primary transfer bias which is applied to the intermediate transfer member 20*a* or 20*b* from an electric power source 61 at a nip portion of the photosensitive body 1 and the intermediate transfer member 20*a* or 20*b*. After the transfer, the surface of the photosensitive body 1 is cleaned with a cleaning unit 14. The same operation as the above is repeated by the consecutive use of development units 42 to 44. Thus, a cyan toner C image as a second color, a yellow toner Y image as a third color and a black toner B image as a fourth color are superimposedly transferred consecutively to the intermediate transfer member 20*a* or 20*b* with the result that there is formed a compound color toner image corresponding to the objective color image.

Subsequently, a transfer roller 25 abuts against the intermediate transfer member 20*a* or 20*b*. A recording medium 24 such as paper is supplied to a nip portion thereof from a paper supply cassette 9. Simultaneously, secondary transfer bias is applied to the member from an electric power source 29 and the compound color toner image is transferred from the intermediate transfer member 20*a* or 20*b* to the recording medium 24, which is introduced to a fixing unit 15 and heat fixed to form the final image. The toner left after the transfer on the intermediate transfer member 20*a* or 20*b* is cleaned by a cleaning unit 35 abutting against said member.

There is no specific limitation on the constitution of the intermediate transfer member according to the present invention, provided that the member has the above-specified universal hardness or Z value. Preferably, said member is composed of an elastic layer and a coating layer installed on the surface thereof from the viewpoint of ease of regulating the universal hardness to a desired value. In addition, there are usable as necessary, a core made of a metal or plastics, reinforcing thread, reinforcing cloth and the like. Moreover, a plurality coating layers may be equipped as necessary.

Figure 3:
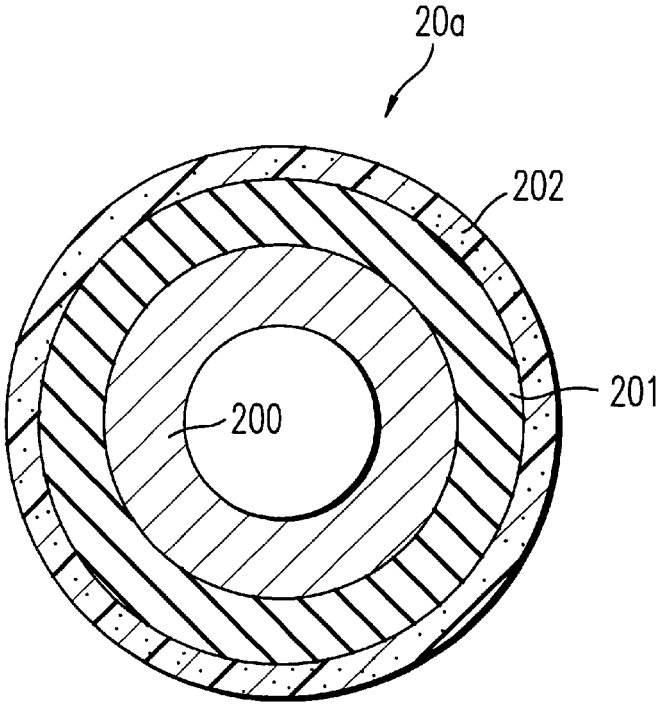
FIG. 3 is a cross sectional view showing the constitution of an example of an intermediate transfer member in the form of drum according to the present invention.

FIG. 3 is a cross sectional view showing the constitution of an example of an intermediate transfer member in the form of drum according to the present invention, in which the drum type intermediate transfer member 20*a* is constituted of a cylindrical core 200, an elastic layer 201 installed around said member and a coating layer 202 further installed around said elastic layer.

Figure 4:
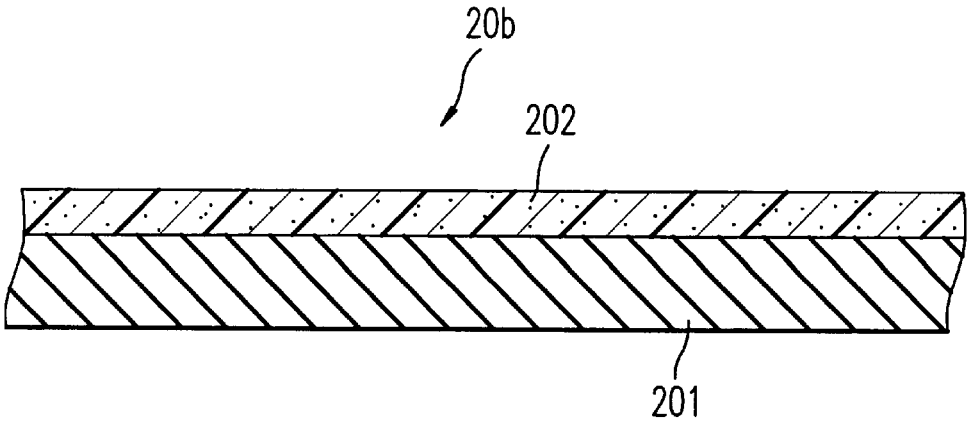
FIG. 4 is a cross sectional view showing the constitution of an example of an intermediate transfer member in the form of belt according to the present invention.

FIG. 4 is a cross sectional view showing the constitution of an example of an intermediate transfer member in the form of belt according to the present invention, in which the belt type intermediate transfer member 20*b* is constituted of an elastic layer 201 and a coating layer 202 installed around said elastic layer.

There is no specific limitation on the material of construction for the above-mentioned elastic layer and coating layer. The materials for the two layers as described hereinafter are preferably used in combination in order to control the universal hardness and Z value in the foregoing formula (I) each within a desired range, and at the same time, assure favorable bonding properties even during a long-term service.

The elastic layer preferably comprises at least one rubber material as a principal component. Examples of the rubber material include nitrile rubber, ethylene propylene rubber, styrene butadiene rubber, butadiene rubber, isoprene rubber, natural rubber, silicone rubber, urethane rubber, acrylic rubber, chloroprene rubber, butyl rubber and epichlorohydrin rubber. The above-exemplified rubber material may be used alone or in combination with at least one other. Of these are preferable epichlorohydrin rubber, ethylene propylene rubber and a blend thereof with an other rubber material.

Moreover, in order to impart electroconductivity to the elastic layer, it is usually incorporated with an electroconductivity imparting agent, which is classified into ionic electroconductivity imparting agent and electronic electroconductivity imparting agent. Examples of the ionic electroconductivity imparting agent include ammonium salts such as perchlorates, chlorates, hydrochlorides, bromates, iodates, borofluorides, sulfates, alkyl sulfates, carboxylates, sulfonates, etc. of any of tetraethyl ammonium, tetrabutyl ammonium, dodecyltrimethyl ammonium such as lauryltrimethyl ammonium, octadecyltrimethyl ammonium such as stearyltrimethyl ammonium, hexadecyltrimethyl ammonium, benzyltrimethyl ammonium, modified aliphatic dimethylethyl ammonium, etc.; perchlorates, chlorates, hydrochlorides, bromates, iodates, borofluodides, trifluoromethyl sulfates, sulfonates, etc. of any of alkali metals such as lithium, sodium and potassium, or alkaline earth metals such as calcium and magnesium.

Examples of the electronic electroconductivity imparting agent include electroconductive carbon black such as ketchen black and acetylene black; carbon black for rubber such as SAF, ISAF, HAF, FEF, GPF, SRF, FT and MT; oxidation treated carbon black for ink; thermally cracked carbon black; graphite; electroconductive metal oxides such as tin oxide, titanium oxide and zinc oxide; and metals such as nickel and copper.

The above-exemplified electroconductivity imparting agent may be used alone or in combination with at least one other. The amount thereof to be added is not particularly limited, but may be selected according to various situations. In the case of an ionic electroconductivity imparting agent, the amount thereof to be added is usually 0.01 to 5 parts by weight, preferably 0.05 to 2 parts by weight based on 100 parts by weight of a rubber material. In the case of an electronic electroconductivity imparting agent, the amount thereof to be added is usually 1 to 50 parts by weight, preferably 5 to 40 parts by weight based on 100 parts by weight of a rubber material. It is preferable to regulate the specific volume resistance of the electroconductive elastic layer to $10^3$ to $10^{10}$ Ω·cm, particularly up to $10^4$ to $10^8$ Ω·cm.

On the other hand, the material of construction for the coating layer is preferably a material which has favorable follow-up properties for the elongation of the above-mentioned elastic layer, and is capable of controlling the universal hardness or Z value in the foregoing formula (I) to a desired range or value. It is preferably, for example, polyurethane resin.

Examples of preferable polyol component for the polyurethane resin include well known polyol component which has heretofore been used as a starting material for polyurethane resin such as polyether base polyol, polyester base polyol and polyolefin base polyol, of which are preferable polyester base polyol and polyolefin base polyol in the present invention.

Preferable examples of polyester base polyol include condensation reaction series polyester polyol which is obtained by the condensation reaction of a dicarboxylic acid and a diol or a triol or the like, lactone series polyester polyol which is obtained by subjecting lactone to ring opening polymerization in the presence of a diol or triol, and ester-modified polyol which is obtained by ester-modifying an end of a polyether polyol with lactone. Preferable examples of polyolefin base polyol include polyisoprene polyol, polybutadiene polyol, hydrogenated polybutadiene polyol. The above-exemplified polyol component may be used alone or in combination with at least one other.

On the other hand, examples of preferable polyisocyanate component for the polyurethane resin include well known polyisocyanate compound (having at least two isocyanate groups in one molecule) which has heretofore been used as a starting material for polyurethane resin. Specific examples thereof include tolylene diisocyanate, diphenylmethane diisocyanate, naphthalene diisocyanate, tolidine diisocyanate, hexamethylene diisocyanate, isophorone diisocyanate, phenylene diisocyanate, xylylene diisocyanate, tetramethylxylylene diisocyanate, cyclohexane diisocyanate, lysine eser diisocyanate, lysine ester triisocyanate, undecane triisocyanate, hexamethylene triisocyanate, triphenylmethane triisocyanate, and any of polymers, derivatives, modified products and hydrogenated products of any of these polyisocyanate compound.

Of these polyisocyanate compounds, is preferable at least one species selected from the group consisting of aliphatic polyisocyanate compounds, alicyclic polyisocyanate compounds, and hydrogenated aromatic polyisocyanate compounds because of its capability of affording polyurethane resin with favorable ozone resistance.

Particularly preferable polyisocyanate compounds among them are modified hexamethylene diisocyanate and modified isophorone diisocyanate. Of these are most preferable isocyanurate modified product, bullette modified product and adduct modified product because of excellent heat resistance.

It is possible as desired to add another additive to the coating layer for the purpose of decreasing the friction and adhesiveness to prevent toner adhesion, or for the purpose of regulating charging properties, electrostatic capacity and electric resistance to control the electrostatic behavior of toner, said additive being exemplified by a resin such as fluororesin, silicone resin, polyester resin, acrylic resin, acrylurethane resin, acrylsilicone resin, epoxy resin, phenolic resin, melamine resin, and the like, fine particles of fluororesin, fine particles of silicone resin, load controlling agent and the like.

The electric resistance of the coating layer is set preferably to a value higher than that of the elastic layer, and advantageously in the range of about $10^6$ to $10^{16}$ Ω·cm, expressed in terms of specific volume resistance. In the case where an electroconductivity imparting agent is used to regulate the electric resistance thereof, said agent may be selected for use from those that have been each exemplified as an electroconductivity imparting agent in the foregoing item of the elastic layer.

The present invention further provides the image formation apparatus which is equipped with the above-mentioned intermediate transfer member, and is exemplified by those shown in FIGS. 1 and 2.

The intermediate transfer member according to the present invention exerts the working effects of preventing toner fixing and enhancing the durability thereof by virtue of the above described specific constitution in that the universal hardness of said member in a depth equivalent to the average particle size of toners used in an electrophotographic image formation apparatus is properly corrected. Further, said member is capable of properly correcting the deformation energy behavior in an extremely shallow region of the member surfaces which greatly influences the toner encroaching or the deformation due to contact of the member with a photosensitive body, secondary transfer member, cleaning member and the like and at the same time, effectively preventing the deformation accompanying the repeated contact of the member with a toner, photosensitive body, secondary transfer member, cleaning member and the like, whereby the durability of said member is surely enhanced.

In the following, the present invention will be described in further detail with reference to comparative examples and working examples, which however shall not limit the present invention thereto.

EXAMPLE 1

A rubber belt having a width of 240 mm, one round length of 450 mm and a thickness of 1 mm was fabricated by winding woven fabric around a mandrel, installing thereon an elastic layer composed of a rubber material in which carbon black has been added to a mixture of ethylene propylene rubber and nitrile rubber to regulate the electric resistance, and vulcanizing molding the resultant assembly. The resultant rubber belt had a specific volume resistance of $2.1\times10^6$ Ω·cm.

Aside therefrom, a coating material of urethane resin was prepared by blending 50 parts by weight of a polyester base polyol-containing product (one component base solvent bone dry type, solid content of 50% by weight, manufactured by Nippon Polyurethane Co. Ltd. under the trade name "Nippolan 3124"), 11 parts by weight of modified tolylene diisocyanate (solid content of 75% by weight, manufactured by Nippon Polyurethane Co. Ltd. under the trade name "Coronate L"), 10 parts by weight of powdery polytetrafluoroethylene (average particle size of 0.3 μm) and 100 parts by weight of methyl ethyl ketone.

Then, an intermediate transfer member (an intermediate transfer belt) in the form of belt covered with a coating layer of polyurethane resin in a thickness of 30 μm was prepared by spraying the coating material thus prepared on the above-mentioned elastic layer of rubber belt. The belt thus prepared had a specific volume resistance of $3.\times10^{13}$ Ω·cm.

Subsequently, the universal hardness of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

The universal hardness at a depth of 7 μm was found to be 11.5 $N/mm^2$.

The intermediate transfer belt thus prepared was mounted to a full color printer as exemplified by FIG. 2, and an image durability test was carried out by the use of a toner having an average particle size of about 7 μm at a cyan density of 10%.

As a result, no image abnormality was caused even at the time when 20,000 sheets of color printing were produced.

EXAMPLE 2

The procedure in Example 1 was repeated to prepare an intermediate transfer member (an intermediate transfer belt in the form of belt except that a coating material of urethane resin was prepared by blending 50 parts by weight of "Nippolan 3124" (same as that in Example 1), 11 parts by weight of modified hexamethylene diisocyanate (solid content of 75% by weight, manufactured by Asahi Chemical Industry Co. Ltd. under the trade name "Duranate 22A-75PX"), 10 parts by weight of powdery polytetrafluoroethylene (average particle size of 0.3 μm) and 100 parts by weight of methyl ethyl ketone. The belt thus prepared had a specific volume resistance of $5.1\times10^{13}$ Ω·cm.

Subsequently, the universal hardness of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

The universal hardness at a depth of 7 μm was found to be 15.4 $N/mm^2$.

The intermediate transfer belt thus prepared was mounted to a full color printer as exemplified by FIG. 2, and an image durability test was carried out by the use of a toner having an average particle size of about 7 μm at a cyan density of 10%.

As a result, no image abnormality was caused even at the time when 20,000 sheets of color printing were produced.

EXAMPLE 3

A rubber belt having a width of 240 mm, one round length of 450 mm and a thickness of 1 mm was fabricated by winding woven fabric around a mandrel, installing thereon an elastic layer composed of a rubber material in which carbon black has been added to a mixture of ethylene propylene rubber and nitrite rubber to regulate the electric resistance, and vulcanizing molding the resultant assembly. The resultant rubber belt had a specific volume resistance of $3.2\times10^{6}$ Ω·cm.

Aside therefrom, a coating material of urethane resin was prepared by blending 50 parts by weight of "Nippolan 3124" (same as that in Example 1), 10.5 parts by weight of modified tolylene diisocyanate ("Coronate L", same as that in Example 1), 10 parts by weight of powdery polytetrafluoroethylene average particle size of 0.3 μm) and 100 parts by weight of methyl ethyl ketone.

Then, an intermediate transfer member (an intermediate transfer belt) in the form of belt covered with a coating layer of polyurethane resin in a thickness of 30 μm was prepared by spraying the coating material thus prepared on the above-mentioned elastic layer of rubber belt. The belt thus prepared had a specific volume resistance of $3.5\times10^{13}$ Ω·cm.

Subsequently, the Z value in the formula (I) of the surface of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

Retention time at the maximum load: 10 seconds.

Period of time of removing load: 10 seconds.

As a result, the Z value was found to be 0.71.

The intermediate transfer belt thus prepared was mounted to a full color printer as exemplified by FIG. 2, and an image durability test was carried out by the use of a toner at a cyan density of 10%.

As a result, no image abnormality was caused even at the time when 20,000 sheets of color printing were produced.

EXAMPLE 4

The procedure in Example 1 was repeated to prepare an intermediate transfer member (an intermediate transfer belt in the form of belt except that a coating material of urethane resin was prepared by blending 50 parts by weight of "Nippolan 3124" (same as that in Example 1), 10 parts by weight of modified hexamethylene diisocyanate ("Duranate 22A-75PX", same as that in Example 2), 10 parts by weight of powdery polytetrafluoroethylene (average particle size of 0.3 μ) and 100 parts by weight of methyl ethyl ketone. The belt thus prepared had a specific volume resistance of $4.3\times10^{13}$ Ω·cm.

Subsequently, the Z value in the formula (I) of the surface of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

Retention time at the maximum load: 10 seconds.

Period of time of removing load: 10 seconds.

As a result, the Z value was found to be 0.69.

The intermediate transfer belt thus prepared was mounted to a full color printer as exemplified by FIG. 2, and an image durability test was carried out by the use of a toner at a cyan density of 10%.

As a result, no image abnormality was caused even at the time when 20,000 sheets of color printing were produced.

COMPARATIVE EXAMPLE 1

A resin composition in the form of pellet was prepared by adding 10 parts by weight of carbon black to 100 parts by weight of polycarbonate and melt kneading the resultant blend. Then an intermediate transfer member (an intermediate transfer belt) having a thickness of 170 μm was prepared by extruding the resultant resin composition into a state of molten tube by the use of an extruder, and solidifying by cooling in contact with a cooled mandrel. The belt thus prepared had a specific volume resistance of $4.3\times10^{12}$ Ω·cm.

Subsequently, the universal hardness of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

The universal hardness at a depth of 7 μm was found to be 89.2 $N/mm^2$.

The intermediate transfer belt thus prepared was mounted to a full color printer as exemplified by FIG. 2, and an image durability test was carried out by the use of a toner having an average particle size of about 7 μm at a cyan density of 10%.

As a result, defective dotted image began to appear at the time when 8,000 sheets of color printing were produced. Thus the intermediate transfer belt was taken out from the printer and observed. As a result, there were found portions where a large number of toner particles had been embedded.

COMPARATIVE EXAMPLE 2

A resin composition in the form of pellet was prepared by adding 9 parts by weight of carbon black to 100 parts by weight of polybutylene terephthalate and melt kneading the resultant blend. Then an intermediate transfer member (an intermediate transfer belt) having a thickness of 175 μm was prepared by extruding the resultant resin composition into a state of molten tube by the use of an extruder, and solidifying by cooling in contact with a cooled mandrel. The belt thus prepared had a specific volume resistance of $2.1\times10^{12}$ Ω·cm.

Subsequently, the universal hardness of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

The universal hardness at a depth of 7 μm was found to be 92.3 $N/mm^2$.

The intermediate transfer belt thus prepared was mounted to a full color printer as exemplified by FIG. 2, and an image durability test was carried out by the use of a toner having an average particle size of about 7 μm at a cyan density of 10%.

As a result, detective dotted image began to appear at the time when 7,500 sheets of color printing were produced. Thus the intermediate transfer belt was taken out from the printer and observed. As a result, there were found the portions where a large number of toner particles had been embedded.

COMPARATIVE EXAMPLE 3

A resin composition in the form of pellet was prepared by adding 10 parts by weight of carbon black to 100 parts by weight of polycarbonate and melt kneading the resultant blend. Then an intermediate transfer member (an intermediate transfer belt) having a width of 240 mm, one round length of 450 mm and a thickness of 155 μm was prepared by extruding the resultant resin composition into a state of molten tube by the use of an extruder, and solidifying by cooling in contact with a cooled mandrel. The belt thus prepared had a specific volume resistance of $4.3\times10^{12}$ Ω·cm.

Subsequently, the Z value in the formula (I) of the surface of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

Retention time at the maximum load: 10 seconds.

Period of time of removing load: 10 seconds.

As a result, the Z value was found to be 0.48.

The intermediate transfer belt thus prepared was mounted to a full color printer as exemplified by FIG. 2, and an image durability test was carried out by the use of a toner at a cyan density of 10%.

As a result, the image uniformity began to deteriorate and at the same time, unevenness of density began to take place at the time when 7,500 sheets of color printing were produced. Thus the intermediate transfer belt was taken out from the printer and observed. As a result, there were found numerous indented portions and the portions where a large number of toner particles had been embedded.

COMPARATIVE EXAMPLE 4

A resin composition in the form of pellet was prepared by adding 9 parts by weight of carbon black to 100 parts by weight of polybutylene terephthalate and melt kneading the resultant blend. Then an intermediate transfer member (an intermediate transfer belt) having a width of 240 mm, one round length of 450 mm and a thickness of 175 μm was prepared by extruding the resultant resin composition into a state of molten tube by the use of an extruder, and solidifying by cooling in contact with a cooled mandrel. The belt thus prepared had a specific volume resistance of $4.3\times10^{12}$ Ω·cm.

Subsequently, the Z value in the formula (I) of the surface of the intermediate transfer belt was measured by the use of a ultracompact hardness meter (manufactured by Fischer Corp. under the trade name H-100V) under the measuring conditions as detailed hereunder.

Penetrator: diamond made quadrangular pyramid penetrator having an opposite plane angle of 136 deg.

Initial load: 0.02 mN

Maximum load: 100 mN

Period of time of increasing load from initial load to maximum load: 10 seconds.

Retention time at the maximum load: 10 seconds.

Period of time of removing load: 10 seconds.

As a result, the Z value was found to be 0.46.

The intermediate transfer belt thus prepared was mounted to a full color printer as exemplified by FIG. 2, and an image durability test was carried out by the use of a toner at a cyan density of 10%.

As a result, the image uniformity began to deteriorate and at the same time, unevenness of density began to take place at the time when 6,900 sheets of color printing were produced. In addition, when letter patterns were printed, local distortion took place. Thus the intermediate transfer belt was taken out from the printer and observed. As a result, there were found numerous indented portions and the portions where a large number of toner particles had been embedded.

What is claimed is:

1. An intermediate transfer member which is located between an image formation body and a recording medium, which once retains on a surface thereof, a toner image formed on the image formation body, and transfers said image to a recording medium, wherein said intermediate transfer member has a Z value of at least 0.5, said Z value being calculated by the following formula:

$$Z=[\text{elastic energy}]/[\text{elastic energy}+\text{plastic energy}] \quad \text{(I)}$$

said formula being obtained from a deformation restoration behavior of a surface of said member at the time of measuring a universal hardness of a surface thereof.

2. The intermediate transfer member according to claim 1, wherein a specific volume resistance thereof is in the range of $10^3$ to $10^{16}$ Ω·cm.

3. The intermediate transfer member according to claim 1, which comprises an elastic layer and at least one coating layer which is disposed on a surface thereof.

4. The intermediate transfer member according to claim 3, wherein the coating layer comprises at least polyurethane resin.

5. The intermediate transfer member according to claim 4, wherein the polyurethane resin is produced from a polyester base polyol and/or polyolefin base polyol as a polyol component.

6. The intermediate transfer member according to claim 4, wherein the polyurethane resin is produced from at least one species selected from the group consisting of aliphatic polyisocyanate compounds, alicyclic polyisocyanate compounds and hydrogenated aromatic polyisocyanate compounds as a polyisocyanate component.

7. The intermediate transfer member according to claim 6, wherein the polyisocyanate component is modified hexamethylene diisocyanate or modified isophorone diisocyanate.

8. The intermediate transfer member according to claim 3, wherein the elastic layer comprises ethylene propylene rubber, epichlorohydrin rubber or a mixture of any of said rubber and an other rubber material.

9. An image formation apparatus, which comprises the intermediate transfer member according to claim 1.

* * * * *